United States Patent [19]

Brown

[11] Patent Number: 4,631,503

[45] Date of Patent: Dec. 23, 1986

[54] GROOVED WAVEGUIDE SHORTING BLOCK AND METHOD OF ASSEMBLY

[75] Inventor: Paul R. Brown, Marlton, N.J.

[73] Assignee: RCA Corporation, Princeton, N.J.

[21] Appl. No.: 749,272

[22] Filed: Jun. 27, 1985

[51] Int. Cl.[4] ..... H01P 1/28; H01P 1/397

[52] U.S. Cl. ..... 333/24.1; 333/248; 333/253; 29/600

[58] Field of Search ..... 383/22 R, 24.1, 158, 383/248, 253, 26; 29/600

[56] References Cited

U.S. PATENT DOCUMENTS

| | | | |
|---|---|---|---|
| 2,374,498 | 4/1945 | Quayle | 333/248 X |
| 2,666,186 | 1/1954 | Williams et al. | 333/253 |
| 2,922,963 | 1/1960 | Beatty | 333/248 X |
| 3,368,162 | 2/1968 | Shaw et al. | 333/24.1 |
| 4,349,790 | 9/1982 | Landry | 333/24.1 |

*Primary Examiner*—Paul Gensler
*Assistant Examiner*—Benny Lee
*Attorney, Agent, or Firm*—Joseph S. Tripoli; Robert L. Troike; Robert Ochis

[57] ABSTRACT

A waveguide or waveguide phase shifter is terminated with a short circuit provided by a rigid conductive block which is sized to be a close tolerance fit within the waveguide. The block has grooves in its faces adjacent to the waveguide walls. The walls of the waveguide are deformed to project into these grooves to permanently secure the waveguide to the block.

6 Claims, 4 Drawing Figures

GROOVED WAVEGUIDE SHORTING BLOCK AND METHOD OF ASSEMBLY

The Government has rights to this invention pursuant to Contract No. N00024-84-C-5107 awarded by the Department of the Navy.

The present invention relates to the field of terminated waveguides and more particularly to the field of terminated waveguide phase shifters.

Waveguides and waveguide phase shifters having a shorted termination at one end of the waveguide are known in the art. Such a waveguide phase shifter and its shorting termination are disclosed in U.S. Pat. No. 4,349,790 issued to Norman Landry which is assigned to the present assignee. That patent teaches short circuit terminating one end of the waveguide. That short circuit must terminate the waveguide and be in substantial contact with the loading gyromagnetic dielectric material in order to provide the phase shifter with its desired operating characteristics. That patent discloses a short circuit plate attached to the waveguide by spring fingers extending from two edges of the plate. Such a termination can be difficult to assemble in a reliable manner.

A waveguide shorting termination which can reliably short circuit a waveguide while providing ensured contact to a loading dielectric is needed which is easily and, quickly assembled in the reliable manner.

SUMMARY OF THE INVENTION

The present invention provides a short circuit waveguide termination comprising a solid conducting block sized to fit within the waveguide with its lateral faces in contact with the waveguide walls. This conducting block has grooves therein extending perpendicular to the waveguide propagation direction. The broad walls of a rectangular waveguide are deformed into these grooves to provide an RF seal around the edges of the block and a secure connection between the waveguide and the terminating block. Firm contact between the loading dielectric and the terminating block is ensured so long as the terminating block is held in contact with that dielectric during the deforming operation.

DETAILED DESCRIPTION

Figure 1:
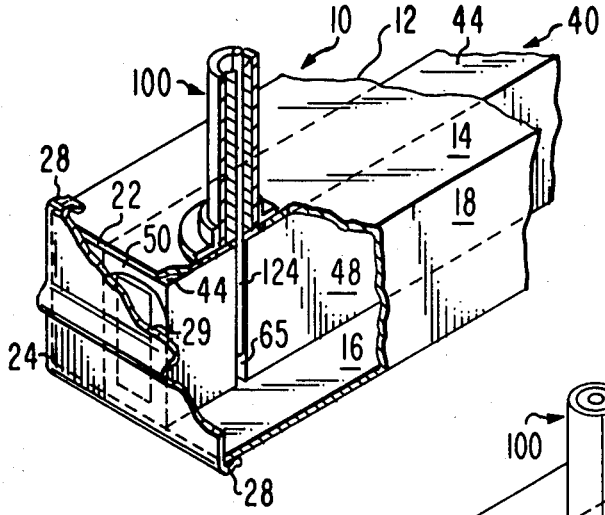
Fig. 1 PRIOR ART
FIG. 1 illustrates a prior art short circuit waveguide termination.

In FIG. 1 a prior art short circuit terminated waveguide phase shifter 10 is illustrated in perspective view. A compliant waveguide 12 has top and bottom broad walls 14 and 16, respectively, and a narrow side wall 18. Waveguide 12 contains a loading dielectric 40 which has an upper surface 44 and in a waveguide phase shifter may be a gyromagnetic toroid. RF signals are coupled from a coaxial cable 100 into the loaded waveguide 12 via an E-plane probe 124 located in a slot 65 in the side face 48 of the loading dielectric 40.

The end 22 of the waveguide 12 is terminated in a short circuit by plate 24 which is retained on the waveguide by spring clips 28 extending from opposing edges of the plate. The plate 24 is secured in contact with the end face 50 of the loading dielectric 40 by an adhesive layer 29. Proper assembly of such a termination requires that the end face 50 of the gyromagnetic dielectric material be positioned where the thin adhesive layer 29 can hold the inner flat face of the plate in secure, uniform, intimate contact with end face 50. Mispositioning of the termination can cause improper phase shifter operation by providing a low dielectric constant region between the plate 24 and the end 50 of the loading dielectric and/or can cause leakage of RF energy from the end 12 of the waveguide by providing a gap between the plate 24 and the end 22 of the waveguide 12.

Figure 2:
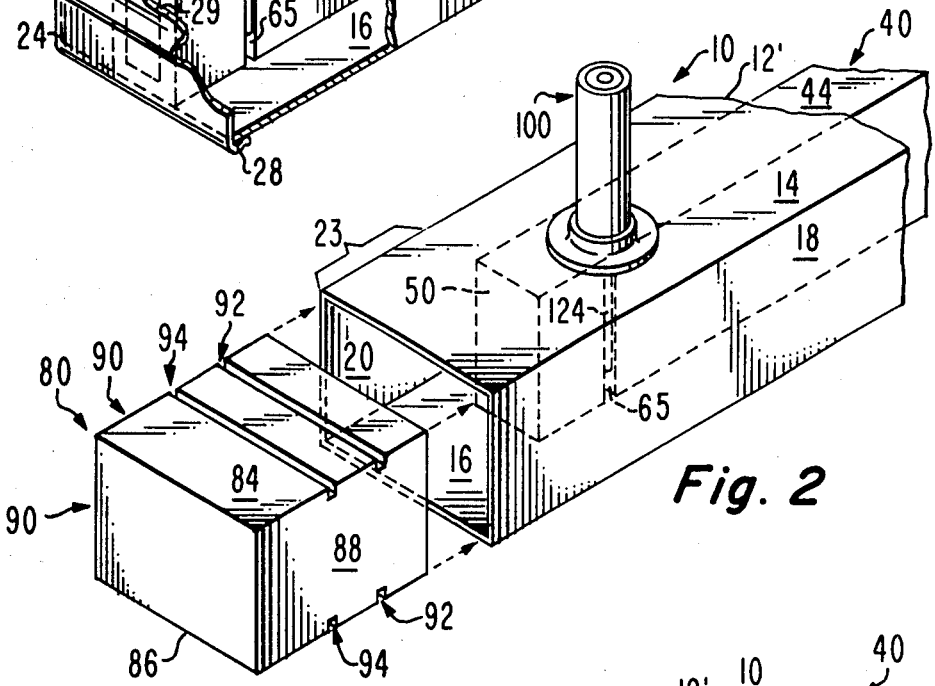
FIG. 2 illustrates an improved short circuit waveguide termination in accordance with the present invention in exploded form.

In FIG. 2 a waveguide termination in accordance with the present invention is illustrated in perspective exploded view. In this configuration, for a given length of loading dielectric material 40, the compliant waveguide 12' in FIG. 2 is made longer than the compliant waveguide 12 of FIG. 1. The loading dielectric 40 with its upper surface 44, the coaxial cable 100, the E-plane probe 124 and the slot 65 in the side face of the loading dielectric are like those in FIG. 1. The extra length of the waveguide 12' serves as a socket into which a conductive block 80 is inserted to short circuit the waveguide at the end 50 of the dielectric 40. The block 80 has a top broad face 84 designed to contact the upper (in the FIGURE) broad wall 14 of the waveguide 12' and has a lower broad face 86 designed to contact the lower (in the FIGURE) broad wall 16 of the waveguide 12'. Block 80 has relatively narrow faces 88 and 90 designed to contact the relatively narrow walls 18 and 20, respectively, of the waveguide 12'. A pair of grooves 92 and 94 are disposed in each of the broad faces 84 and 86 of shorting block 80. The grooves 92 and 94 extend perpendicular to the length of the waveguide 12' and are located within that waveguide when the termination is assembled. The block 80 is sized to be a close tolerance fit within the waveguide so that it substantially fills the end portion 23 of the waveguide into which it is inserted.

Figure 3:
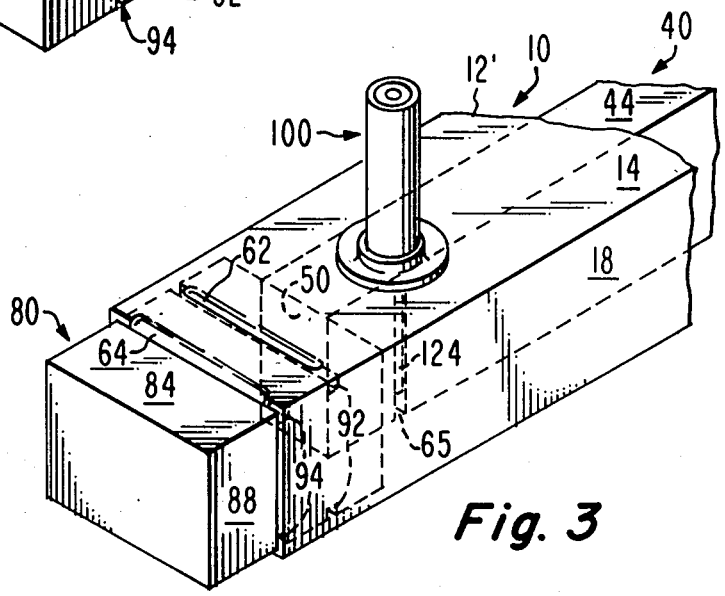
FIG. 3 illustrates the FIG. 2 termination in assembled condition, with waveguide walls crimped into grooves in an end block to form a metallic seal.

This termination is illustrated in assembled condition in FIG. 3 where the block 80 extends into the end portion 23 of waveguide 12' to be in firm contact with an adhesive on the end 50 of gyromagnetic material 40. The top wall 14 of waveguide 12' has crimps 62 and 64 therein extending, respectively, into grooves 92 and 94.

Figure 4:
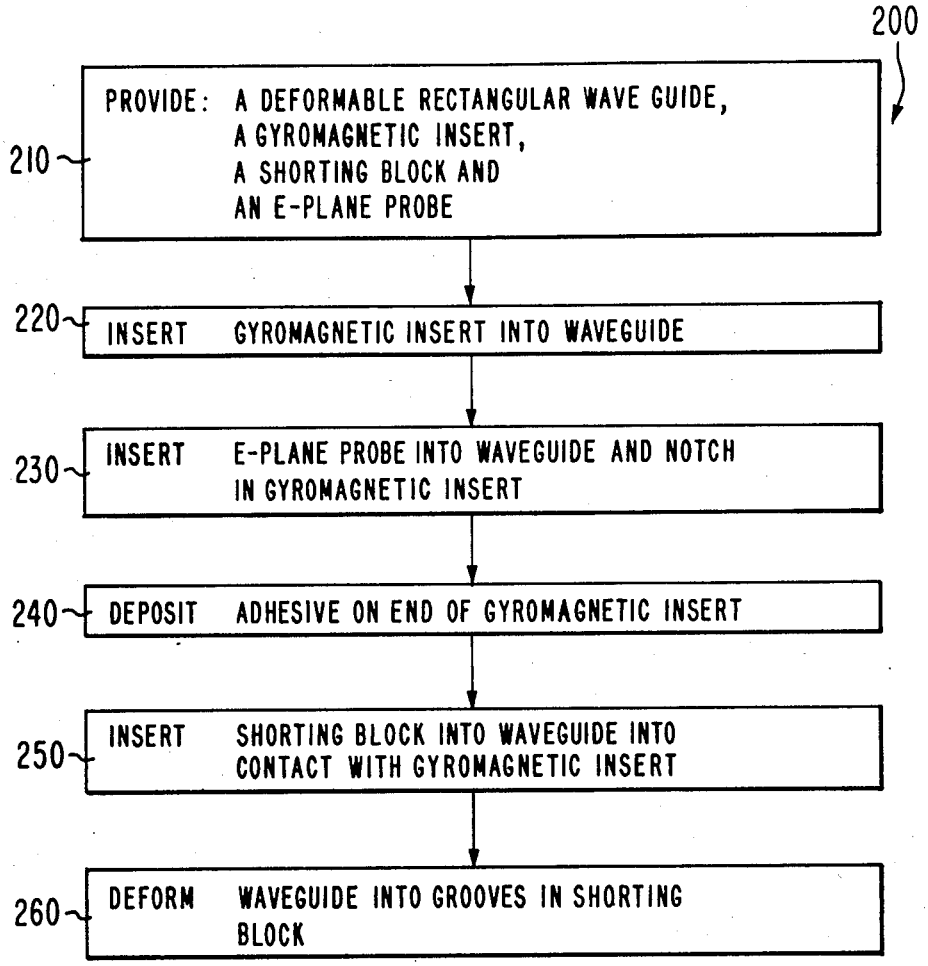
FIG. 4 is a flow chart of the process of assemblying a phase shifter using this termination.

A process 200 for assemblying this phase shifter and its termination is illustrated in FIG. 4. Step 210 comprises providing a deformable conductive rectangular waveguide (12'), a gyromagnetic insert (40) sized to fit within the waveguide in close contact with both broad walls of the waveguide, a rectangular shorting block (80) sized to be a close fit in the interior of the waveguide and an E-plane probe (124).

In step 220, the loading dielectric (gyromagnetic material 40) is inserted into the waveguide 12' to a desired position. In step 230, the E-plane probe 124 is inserted through a broad wall of the waveguide and into the notch 65 in the side of the dielectric 40 and secured there with potting compound in accordance with the teachings of the above mentioned Landry patent. In step 240, an adhesive is deposited on the end face 50 of the dielectric.

In step 250 the shorting block 80 is inserted into the waveguide into contact with the adhesive and the end face 50 of the dielectric 40. In step 260 the broad walls 14 and 16 of the waveguide 12' are crimped or otherwise deformed into the grooves 92 and 94 in block 80. This permanently secures the shorting block 80 within the waveguide and against the end 50 of the dielectric member 40. The crimping of the waveguide ensures the contact of the waveguide broad walls against block 80 which is required to provide a secure RF seal at end 22 of the waveguide. The depth to which the shorting block extends into the waveguide prevents RF leakage between the block 80 and the side walls 18 and 20 of the waveguide. This side seal is partially a result of the fact that the propagating modes in the waveguide have their E-fields parallel to the probe 124 and have zero field strength at the sidewalls 18 and 20. Thus, intimate contact between the sidewalls 18 and 20 and the block 80 is not crucial to RF sealing. In contrast, the seal at the top and bottom walls 14 and 16 requires the intimate contact provided by the deformations or crimps 62 and 64 in the broad walls since the E field along those walls is perpendicular to the walls and has a non-zero field strength. I The crimps are preferably simultaneously induced in both broad walls 14 and 16 of the waveguide 40 by the simultaneous application of matching dies to those walls to deform the waveguide material into the grooves 92 and 94 in a permanent manner. This crimped attachment of the waveguide to the block 80 ensures the provision of the required secure fit between the waveguide and the block even when the waveguide is oversize (at maximum tolerance) and the shorting block is under size (at minimum tolerance). A tight joint between the crimped top and bottom walls 14 and 16 of the waveguide and the shorting block is ensured because the connection is made directly between the two parts whose connection must be maintained.

This contrasts with the situation which would exist if rivets were used to attach the block to the waveguide. The rivets would be intended to clamp the waveguide against the shorting block. However, there are a number of things which can result in an inadequate connection being formed. Among these things are tool wear, variation in rivet head depth, shaft diameter, length and hardness. All of these things can cause inadequate peening of the rivets with the result that the waveguide is not securely attached to the block 80 and an air gap remains between them. Such an air gap allows undesired RF leakage to occur. The use of rivets would also require predrilled holes in the shorting block and the waveguide which add steps to the assembly process. Mispositioning of either set of these holes can cause displacement of the shorting block from the end 50 of the dielectric material.

A further benefit of a termination in accordance with this invention as compared to the use of rivets is a decrease in assembly time, parts count and tooling requirements. This results in an increase in reliability and a reduction in cost.

What is claimed is

1. The combination comprising a deformable, conductive, waveguide having a pair of parallel, opposed relatively broad walls and a pair of parallel, relatively narrow walls extending between said broad walls;

a conductuve rigid block having a pair of substantially parallel, relatively broad faces, a pair of substantially parallel, relatively narrow faces extending between said broad faces and a groove in each of said broad faces extending across said broad faces and substantially perpendicular to said narrow faces;

said block extending into and substantially filling one end of said waveguide with said broad faces in substantial contact with said broad walls, said narrow faces disposed adjacent said narrow walls and said grooves disposed within said waveguide; and deformation in each of said broad walls extending into said groove adjacent thereto for securing said block to said waveguide and providing a radio frequency seal between said block and said broad walls.

2. The combination recited in claim 1 further comprising:

a second groove in each of said broad faces extending across said broad face and substantially parallel to said first recited groove therein; and a second deformation in each of said broad walls extending into said second groove adjacent thereto.

3. The combination recited in claim 1 wherein:

said rigid block has a substantially planar end face disposed within said waveguide and substantially perpendicular to said broad walls and said narrow walls of said waveguide; and said combination further comprises:

a rectangular gyromagnetic member disposed within said waveguide, extending substantially perpendicular to said end face of said rigid block, contacting both of said broad walls of said waveguide and having an end surface adhered to said end face of said rigid block.

4. A method of terminating a rectangular waveguide with a short circuit comprising the steps of:

providing a deformable conductive rectangular waveguide having opposed relatively broad walls and relatively narrow walls extending therebetween and providing a rigid conductive rectangular block having opposed relatively broad faces and relatively narrow faces, said block being sized to fit into and substantially fill an end of said waveguide, said block having a groove in each of its broad faces;

inserting said rigid block into an end of said waveguide to a desired depth with said broad faces adjacent said broad walls and said narrow faces adjacent said narrow walls; and permanently deforming a portion of each of said broad walls into said groove adjacent thereto.

5. The method recited in claim 4 wherein said waveguide comprises a gyromagnetic phase shifter and said method further comprises the steps of:

providing a gyromagnetic body sized to fit within said waveguide and contact the broad walls thereof;

inserting said gyromagnetic body into said waveguide to a prescribed position prior to inserting said rigid block;

depositing an adhesive on an end of said gyromagnetic body; and in said step of inserting said rigid block, inserting it into said waveguide until it is in contact with said adhesive on said gyromagnetic body.

6. The method recited in claim 5 further comprising the step of inserting an E-plane probe through a broad wall of said waveguide and into a notch in said gyromagnetic material prior to inserting said rigid block.

* * * * *